United States Patent [19]

Kern

[11] Patent Number: 4,464,876

[45] Date of Patent: Aug. 14, 1984

[54] SUSPENDED WOODBEAM CEILING CONSTRUCTION

[76] Inventor: Gilbert G. Kern, 515 N. Victory Blvd., Burbank, Calif. 91502

[21] Appl. No.: 407,652

[22] Filed: Aug. 12, 1982

Related U.S. Application Data

[63] Continuation-in-part of Ser. No. 259,858, May 4, 1981, which is a continuation-in-part of Ser. No. 028,904, Apr. 10, 1979, Pat. No. 4,281,498.

[51] Int. Cl.[3] ..... E06B 3/54

[52] U.S. Cl. ..... 52/484; 52/39; 52/665; 52/780; 52/732

[58] Field of Search ..... 52/39, 665, 780, 732, 52/DIG. 8, 484, 313, 483; 403/232.1, 187, 262

[56] References Cited

U.S. PATENT DOCUMENTS

| | | | |
|---|---|---|---|
| 3,589,660 | 6/1971 | Dunckel | 52/39 |
| 3,690,243 | 9/1972 | Lambert | 52/484 |
| 3,785,110 | 1/1974 | Galloway | 52/665 |
| 4,019,300 | 4/1977 | Sauer | 52/665 |
| 4,198,175 | 4/1980 | Knepp | 403/232.1 |
| 4,281,498 | 8/1981 | Kern | 52/780 |
| 4,367,616 | 1/1983 | Pearson | 52/665 |

*Primary Examiner*—Henry E. Raduazo
*Attorney, Agent, or Firm*—Bernard P. Drachlis

[57] ABSTRACT

The suspended woodbeam ceiling is formed of a plurality of beams which lie spaced from each other and at right angles from each other to receive drop-in ceiling panels therebetween. These beams are interconnected with each other, are supported from the overhead, and join the wall rail with the several hardware structures of this invention. The hardware structures engage on one beam and connect it to adjacent structure. Engagement is by lips engaging in grooves and spring teeth engaging in the body of the wood.

4 Claims, 6 Drawing Figures

SUSPENDED WOODBEAM CEILING CONSTRUCTION

CROSS REFERENCE

This application is a continiuation-in-part of my earlier filed pending application Ser. No. 06/259,858 filed May 4,1981, entitled "Suspended Woodbeam Ceiling," now patent No. which in turn, was a continuation-in-part of my earlier filed parent application Ser. No. 28,904 filed Apr. 10, 1979 entitled "Suspended Woodbeam Ceiling," now U.S. Pat. No. 4,281,498.

BACKGROUND

This invention is directed to a suspended woodbeam ceiling construction and more particularly to the hardware for the interconnection and support of the woodbeams of the suspended ceiling.

Many commercial buildings have overhead air conditioning, duct work, pipes and electrical wiring. A suspended ceiling is positioned therebelow to provide a ceiling for the personnel space. The suspended ceiling is often in the shape of an inverted T-bar which is hung on wires from the overhead. Drop-in ceiling panels lie on the crossbars of the T. This permits ready removal of the panels to execute repairs to the overhead equipment.

Some older homes have high ceilings, and it is desirable to install a suspended ceiling therein. Other homes have plaster ceilings which require extensive repair. In such cases, a suspended ceiling is desirable. Furthermore, in modern construction, translucent light panels and opaque decorative panels can serve to enhance decor, particularly of a room which can be enhanced by subdued overhead lighting. There is need for attachment devices which suitably secure together woodbeams of such suspended ceilings.

SUMMARY

In order to aid in the understanding of this invention, it can be stated in essentially summary form that it is directed to a suspended woodbeam ceiling construction and particularly to the devices which attach to the wooden beams for their support and for their attachment to adjacent structure.

It is, thus, an object of this invention to provide a suspended woodbeam ceiling construction which is aesthetic so that it can be employed in locations where an attractive woodbeam ceiling is desirable. It is another object of this invention to provide a woodbeam ceiling construction wherein a beam is formed of a center with two sides, each being made of wood or simulated wood so that the sides present lips for the support of drop-in ceiling panels. It is a further object to provide attachment devices which support such beams intermediate the length thereof and which attach such beams to each other into structure at the wall so that the beams and the ceiling panels associated therewith are properly joined and supported.

Other objects and advantages of this invention will become apparent from a study of the following portion of the specification, the claims and the attached drawings.

DESCRIPTION OF THE PREFERRED EMBODIMENT

Figure 1:
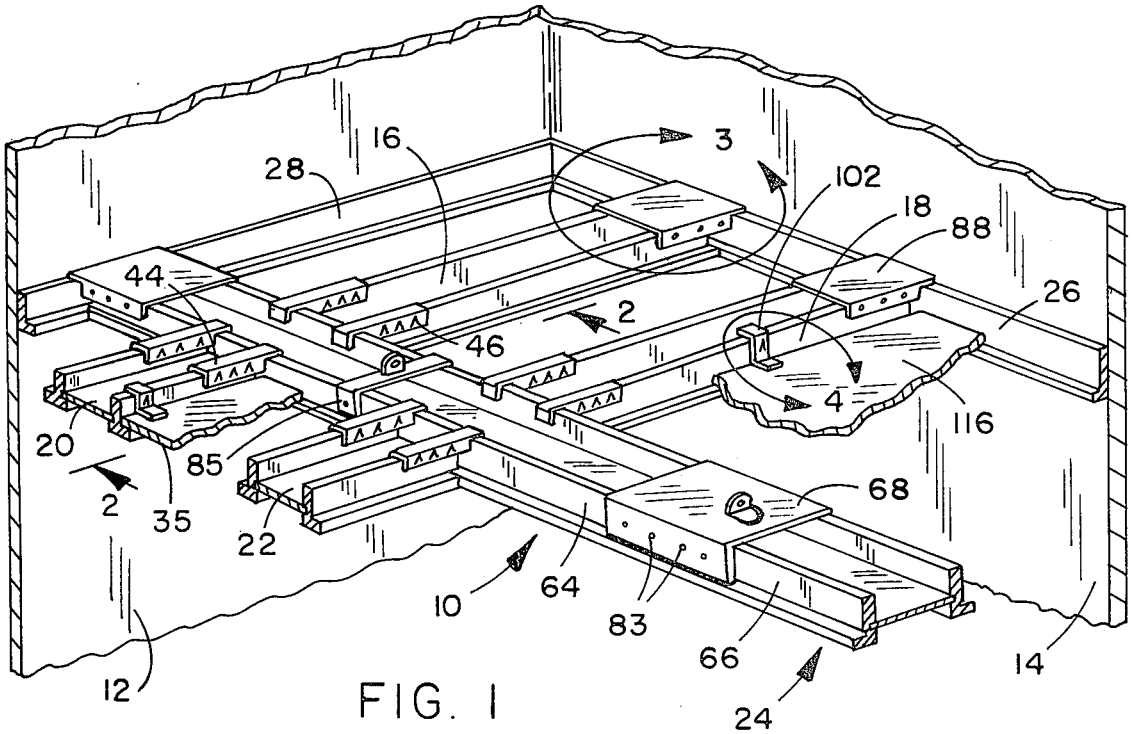
FIG. 1 is an isometric view of a suspended woodbeam ceiling in accordance with this invention, with parts broken away and parts taken in section.

FIG. 1 shows the susupended woodbeam ceiling 10 of this invention as being positioned in a room having walls 12 and 14. The walls intersect at a right angle and enclose a space above the ceiling. The upper space may contain conventional electrical, lighting, and plumbing, as well as heating, cooling, and ventilation equipment. In FIG. 1, the walls of the room are broken away. In the usual room, there are two other walls, and the ceiling 10 extends to those two other walls. Ceiling 10 in FIG. 1 generally comprises a plurality of crossbeams 16, 18, 10, and 22. Crossbeams 20 and 22 are broken away in FIG. 1. FIG. 1 also shows main beam 24 and wall hangers 26 nd 28.

Figure 2:
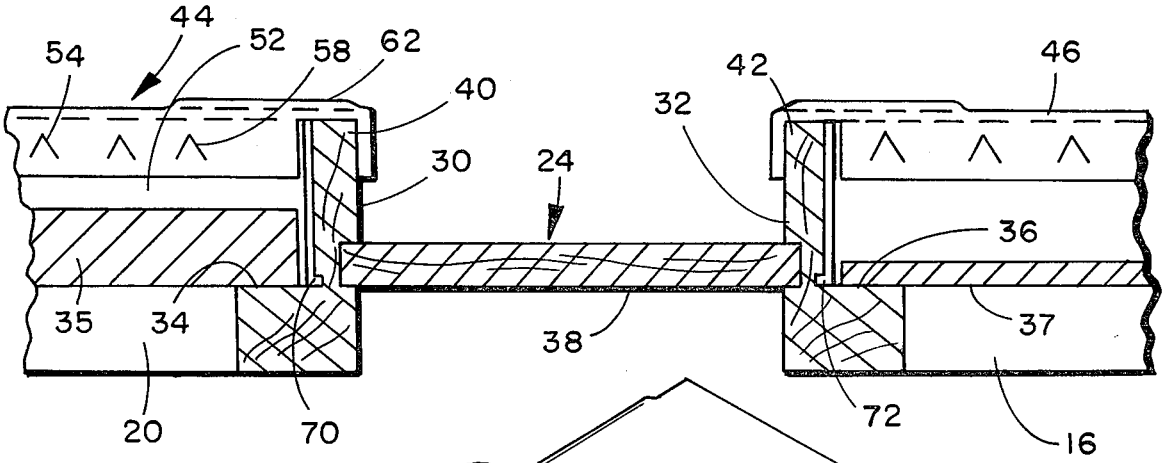
FIG. 2 is an enlarged section taken generally along the line 2—2 of FIG. 1, showing the cross-section of the main beam and showing the ceiling panels supported thereby.

FIG. 2 shows the cross-section of the main beam 24 and the manner in which the metallic fastening clips attach the crossbeams 16 and 20 to the main beam 24. Main beam 24 has beam sides 30 and 32 which are of L-shape configuration. This shape provides lips 34 and 36 on the beam sides which extend away from the center of the beam so that the drop-in ceiling panels can rest thereon. Opaque ceiling panel 35 is shown on the left side of FIG. 2 and translucent ceiling panel 37 is shown on the right side.

Beam center 38 is secured into the beam sides, as by rabbeting and glueing as indicated. Preferably, the bottom of the beam center 38 is in the same plane as the lips 36 and 38, for appearance purposes, but other configurations are feasible. The upstanding webs 40 and 42 respectively of beam sides 30 and 32 provide beam strength to the structure and provide an attachment point for the crossbeams. The structure comprised of beam sides 30 and 32, together with beam center 38, is permanently assembled and is considered a main beam. As seen in FIG. 1, main beam 24 extends the entire distance along the length of the room, from one wall to the other, except for the short length provided by the thickness of the opposing wall hangers. Main beam 24 is supported from the overhead by means of wires engaged with respect to the main beam, such as by the hanger clips 68 illustrated in FIGS. 1 and 6, and described in detail below. Since the woodbeam ceiling of the present invention has much greater strength than the standard T-bar suspended ceiling, the number of suspension wires necessary for the installation of the wood beam ceiling is greatly reduced.

In the preferred embodiment, each of the main beams, crossbeams and wall hangers is preferably made of wood; and in such a case, the three elements of the main beam are glued together and may have additional fastening means. In an alternate embodiment, the main beam may be extruded of thermoplastic, synthetic polymer composition material, and in such a case, it is preferably configured and colored to resemble wood.

Figure 5:
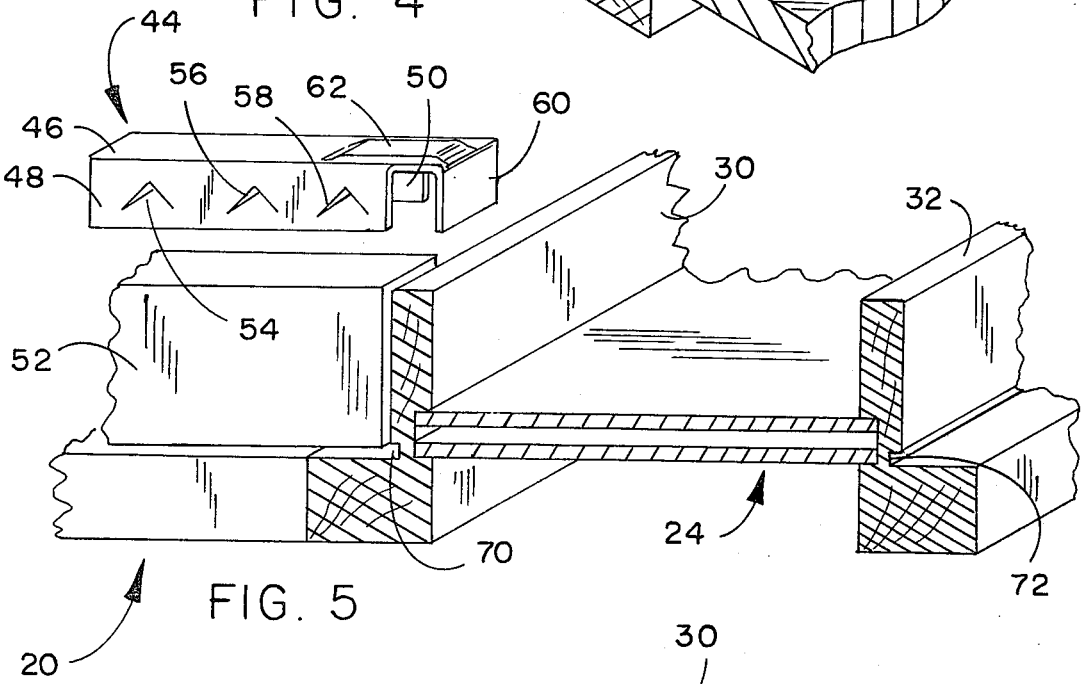
FIG. 5 is a perspective view showing the attachment clip used for attaching the cross rails to the main beam.

Crossbeams 16 and 20, as well as other crossbeams and main beams, have the same cross-section as main beam 24. As is seen in FIGS. 1, 2 and 5, locking clip 44 is used to join crossbeam 20 to the side of main beam 24. Other locking clips of the same construction are used to join each of the other side beams 16, 18 and 22 to the sides of main beam 24. Such an additional locking clip 46 is illustrated in FIGS. 1 and 2. Furthermore, two such locking clips are employed to secure the end of a crossbeam to the side of a main beam, as is shown in FIG. 1. Each of the locking clips is identical.

Locking clip 44 illustrated in FIG. 5 has a main body in the shape of a channel. The channel has web 46 and flanges 48 and 50. The channel is configured to firmly embrace over the upstanding portion of the beam side 52 illustrated in FIG. 5. Furthermore, the flanges have resilient teeth formed therein. Teeth 54, 56 and 58 are illustrated in FIG. 5. They are pressed inward out of the material of the flange to have upwardly and inwardly directed points. The locking clip 44 is formed of sheet metal, from which such teeth can be readily formed. The teeth are directed upward so that the U-shaped channel can be pressed down upon beam side 52 and, when in place, the teeth engage in the sides of the wooden beam side 52 to inhibit removal of the clip. The forward end of locking clip 44 is formed with hook 60 which engages across the top of and down the inside of beam side 30 to retain crossbeam 20 in the endwise direction against the side of main beam 24. Rib 62 is formed along at least the forward portion of web 56 to strengthen hook 60. Thus, by installation of the several locking clips (including the locking clip 44), the crossbeams are held securely in place against the main beam.

Figure 6:
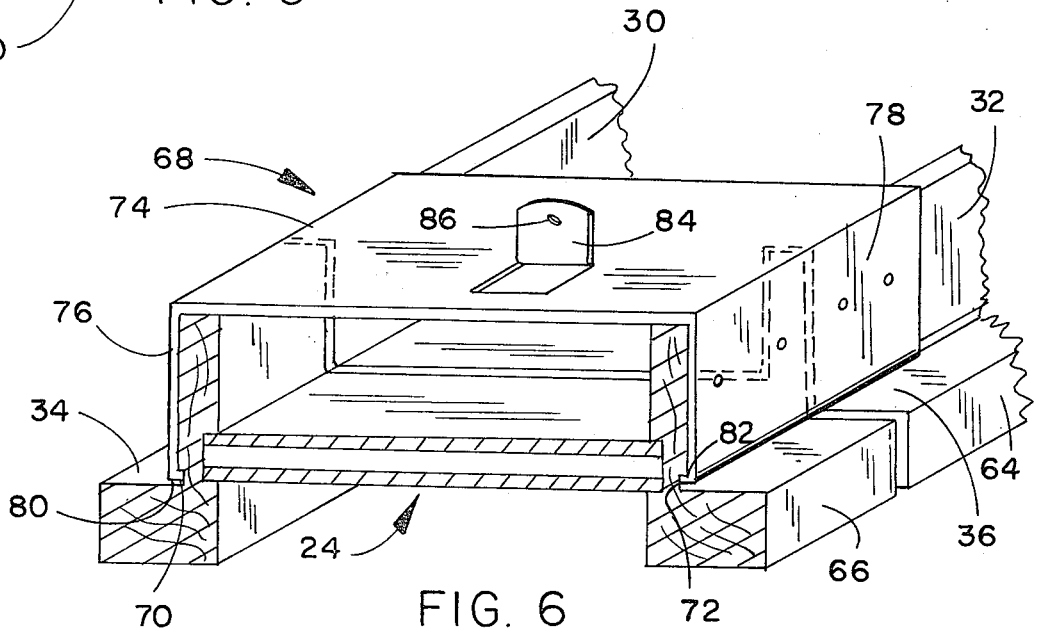
FIG. 6 is a perspective view showing the hanger clip which is used for endwise joining of beams.

When the room is long, it may be that it takes more than one section to provide a main beam 24 which is sufficiently long to span the room. As is seen in FIGS. 1 and 6, sections 64 and 66 are butted end-to-end to provide the necessary span. In order to hold the ends of the sections 64 and 66 in alignment and to support them, extension hanger 68 is provided. In order to receive the fingers of extension hanger 68, the beam sides 30 and 32 are each provided with an undercut notch at the level of the lip. Notches 70 and 72 are seen in FIGS. 2, 5 and 6. These notches are in line with lips 34 and 36 and are cut into the beam sides 30 and 32 on the lip side thereof. Extension hanger 68 is formed of sheet metal and is of generally inverted U-shaped configuration. It has web 74 which spans across the two sections 64 and 66 and spans across the beam sides 30 and 32. Flanges 76 and 78 extend downward along the outer face of the beam sides 30 and 32. At the lower ends of the flanges, inwardly directed fingers 80 and 82 are formed on the flanges and extend into notches 70 and 72, respectively. Extension hanger 68 is, thus, secured onto sections 64 and 66 for both lateral and vertical alignment.

Extension hanger 68 has screw holes 83 in flanges 76 and 78, as shown in FIG. 1. After the extension hanger 68 is in place on sections 64 and 66, the extension hanger 68 may be more permanently secured to sections 64 and 66 by screws through holes 83. The use of screws aid alignment of beam sections 64 and 66 and adds strength to main beam 24.

Tab 84 is bent upward from web 74 and has fastening hole 86 therein. A supporting wire from the overhead may be attached in fastening hole 86 to provide support for extension hanger 68 and, thus, support for both sections 64 and 66 of the main beam 24. Tab 84 is preferably off-center. In this way, the hole in web 74 left by tab 84 will not allow light to show through the junction of sections 64 and 64.

Support hanger 85 is shown in FIG. 1 as support for the beam 64 at one or more selected positions along its length. Support hanger 85 is identical to extension hanger 68, except for its shorter length along the length of the beam. Support hanger 85 has fingers which engage in the notches in the beam, it has an upstanding tab to which a support wire can be secured. Since it has a shorter length, it is not as satisfactory for end-to-end butted beams. However, in view of its shorter length, the support hanger 85 can be resiliently sprung open so that its fingers can engage in the longitudinal notches in the beam. In this way, it is not necessary to slide support hanger 85 on from the end of the beam. It can be snapped in place instead.

Normally, additional support from support hanger 85 is not needed on the crossbeams, but support hanger 85 can be used at any location on the crossbeams or main beam, wherever such support is desirable.

Figure 3:
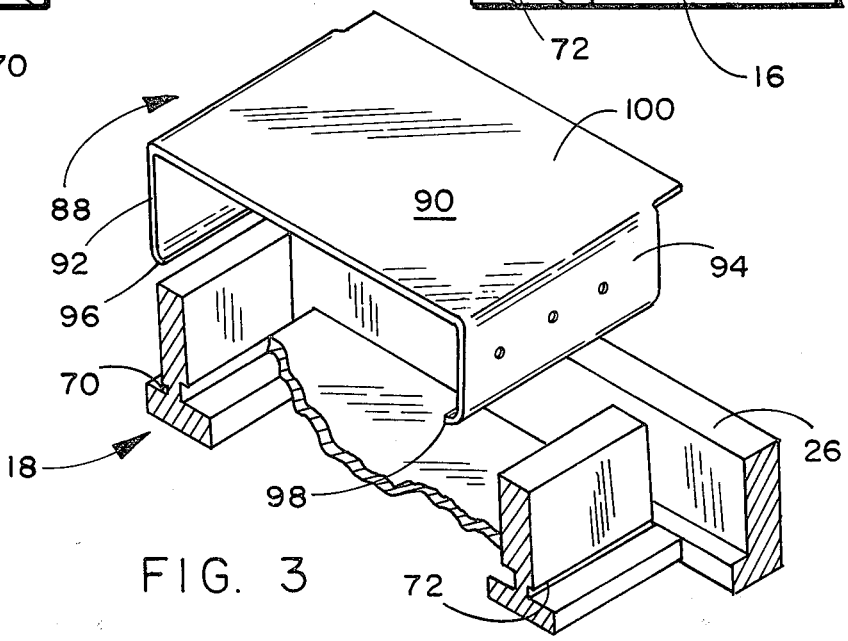
FIG. 3 is an exploded isometric view of the joining of the crossbeam with the wall rail.

FIGS. 1 and 3 illustrate wall rail connector 88. Wall hanger 26 is secured to the wall with its bottom edge positioned to be in line with the bottom surfaces of the main beams and crossbeams. Wall hanger 26 has a lip extending away from the wall in the direction into the room, which lip serves as the support for drop-in ceiling panels. Crossbeam 18 butts against wall hanger 26 and is retained in position by connector 88. Connector 88 is of inverted U-shaped configuration with web 90 and downturned flanges 92 and 94. Flanges 92 and 94, respectively, have inturned fingers 96 and 98 which engage in notches 70 and 72 of crossbeam 18. Wall rail connector is slid onto the end of the cross rail and is positioned so that the extended end 100 overlies the top of wall hanger 26 to provide the support of the end of the crossbeam on the wall hanger. It may be secured in place by screwing or nailing to the crossbeam. It should be noted that beam sides similar to beam sides 30 and 32, but which are not formed into beams, may be used as wall hangers.

Figure 4:
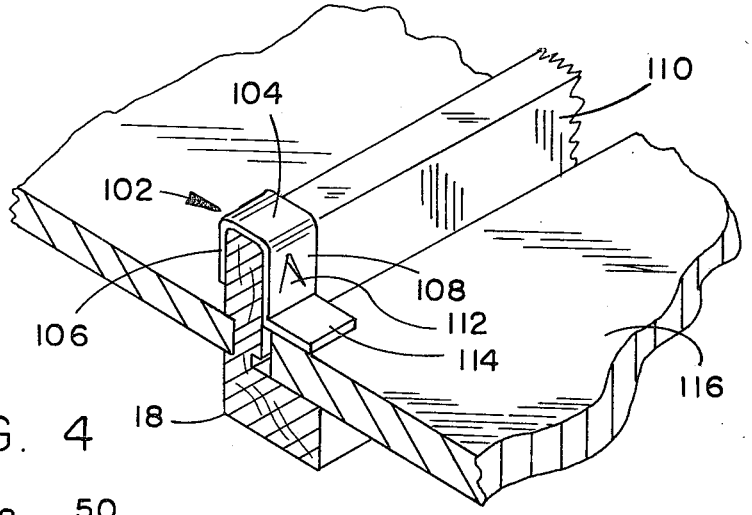
FIG. 4 is an isometric view showing the retaining clip holding down the ceiling panels.

FIGS. 1 and 4 illustrate ceiling panel holddown clip 102. As seen in FIG. 4, holddown clip 102 is of inverted U-shaped configuration. It has web 104 between flanges 106 and 108. The flanges are spaced to embrace the beam side 110, which is the same as beam side 32. Spring tooth 112 is stamped into flange 108 with its point directed towards web 104. The resilience and dimensions are such that tooth 112 engages into beam side 110 to retain clip 102 in place. Finger 114 is formed on the end of flange 108 and is directed outwardly away from the flange. Finger 114 is positioned to engage on the top of ceiling panel 116 which rests on the lip of crossbeam 18. Several of such holddown clips 102 are provided to hold the several ceiling panels in place so that quick changes in air pressure do not cause the ceiling panels to rattle. Ceiling panel 116 may be either a translucent or opaque panel.

Each of the devices described in this specification for support, alignment maintaining, attachment and holddown may be made of stamped sheet metal. The various parts are sufficiently strong to achieve their purpose and have sufficient resiliency so that the teeth by which several of them are held in place are resilient and strong to achieve the desired degree of attachment. Sheet steel is suitable material, but other materials are also suitable. Several of the devices can be cut from extruded thermoplastic synthetic polymer composition material, while locking clip 44 can be injection-molded of similar material. The various devices cooperate together to provide a firm suspended woodbeam ceiling construction which can be readily and accurately assembled.

This invention has been described in its presently contemplated best mode, and it is clear that it is susceptible to numerous modifications, modes and embodiments within the ability of those skilled in the art without the exercise of the inventive faculty. Accordingly, the scope of this invention is defined by the scope of the following claims.

What is claimed is:

1. A suspended woodbeam ceiling comprising:

at least one beam, said beam comprising first and second longitudinal woodbeam side members, each of said woodbeam side members being L-shape, said woodbeam side members each having upwardly facing lip with said lips facing away from each other, a beam center attached to and positioned between said woodbeam side members to maintain said side members apart in spaced relationship, each of said first and second woodbeam side members having a groove along the length thereof with each said groove positioned above said lips so that said grooves face away from each other, each of said grooves having a top toward the upper edge of said woodbeam and a bottom toward said lip of said woodbeam; and attachment means for attaching to said beam, said attachment means having an inverted U-shaped configuration sized so that said attachment means embraces over the top of said beam side members, said engagement means having a flange on each side thereof extending down over the outside of said wood side members, an inturned finger on each said flange adjacent the lower end thereof, said fingers engaging in said grooves, said fingers being spaced the same distance from the web spanning said flanges as said grooves positioned from the tops of said side members so that said web engages the tops of said sidewalls when said fingers are in said grooves, said attachment means being free of engagement with the surfaces of said beam side members which face each other, said attachment means being for engagement with another member for retention of said member with respect to said beam.

2. The ceiling construction of claim 1 wherein a fastening hole is formed with respect to said attachment means for supporting said attachment means from an overhead to support said beam from an overhead.

3. The ceiling construction of claim 1, wherein a hole in said attachment means can be engaged by a supporting wire to support said attachment means and said beam engaged thereby.

4. A suspended woodbeam ceiling comprising:

at least one beam, said beam comprising first and second longitudinal woodbeam side members, each of said woodbeam side members being L-shaped, said woodbeam side members each having upwardly facing lip with said lips facing away from each other, a beam center attached to and positioned between said woodbeam side members to maintain said side members apart in spaced in relationship, each of said first and second woodbeam side members having a groove along the length thereof with each said groove positioned above said lips so that said grooves face away from each other, each of said grooves having a top toward the upper edge of said woodbeam and a bottom toward said lip of said woodbeam; and attachment means for attaching to said beam, said attachment means having an inverted U-shaped configuration sized so that said attachment means embraces over the top of said beam side members, said attachment means having a flange on each side thereof extending down over the outside of said wood side members, an inturned finger on each said flange adjacent the lower end thereof, said fingers engaging in said grooves, said fingers being spaced the same distance from the web spanning said flanges as said grooves are positioned from the tops of said side members so that said web engages the top of said sidewalls when said fingers are in said grooves, said attachment means being free of engagement with the surfaces of said beam side members which face each other, said attachment means being for engagement with another member, said attachment means having an end extended beyond said downwardly extending flanges, said extended end being for positioning beyond the end of the beam to which said attachment means is attached to engage over the top of an adjacent wall hanger for supporting said beam with respect to the wall hanger.

* * * * *